US005404859A

United States Patent [19]

Okuda et al.

[11] Patent Number: 5,404,859

[45] Date of Patent: Apr. 11, 1995

[54] IGNITION SYSTEM FOR INTERNAL COMBUSTION ENGINE

[75] Inventors: Hiroshi Okuda; Toru Ikeda, both of Himeji, Japan

[73] Assignee: Mitsubishi Denki Kabushiki Kaisha, Tokyo, Japan

[21] Appl. No.: 152,147

[22] Filed: Nov. 16, 1993

[30] Foreign Application Priority Data

Nov. 18, 1992 [JP] Japan ..... 4-308960

[51] Int. Cl.[6] ..... F02B 71/02; F02P 3/08

[52] U.S. Cl. ..... 123/598; 123/623

[58] Field of Search ..... 123/597, 598, 623

[56] References Cited

U.S. PATENT DOCUMENTS 4,827,891 5/1989 Miura et al. ..... 123/598

5,074,274 12/1991 Okuda ..... 123/604

FOREIGN PATENT DOCUMENTS 3-124262 5/1991 Japan .

4-21012 5/1992 Japan .

*Primary Examiner*—Tony M. Argenbright

*Attorney, Agent, or Firm*—Sughrue, Mion, Zinn, Macpeak and Seas

[57] ABSTRACT

An ignition system for an internal combustion engine capable of starting the engine even when a battery voltage is insufficient for ignition. A secondary voltage feedback circuit connected to a secondary winding of a transformer constituting a part of a DC—DC converter rectifies a secondary voltage of polarity opposite to that of the voltage applied to an ignition capacitor. The rectified voltage is fed back to the output side of the battery to compensate for lowering of voltage supplied to an ignition control circuit (10) from the battery (3).

12 Claims, 4 Drawing Sheets

IGNITION SYSTEM FOR INTERNAL COMBUSTION ENGINE

BACKGROUND OF THE INVENTION

1. Field of the Invention

The present invention relates generally to an ignition system of capacitor discharge type for an internal combustion engine and more particularly to an ignition system for an internal combustion engine which is equipped with an electric generator adapted to start the generation of electricity in response to actuation, for example, of a kick starter of a two-wheeled automobile.

2. Description of the Related Art

Heretofore, such a capacitive discharge type ignition (CDI) system for an internal combustion engine (hereinafter also referred to simply as the engine) is well known in which a capacitor is previously charged with a boosted voltage for generating a spark discharge at an ignition plug through an ignition coil having a primary winding adapted to be energized by an electric current discharged from the capacitor. The capacitor discharge type ignition system features a property that the fuel mixture within the engine cylinder can be fired without fail even when the spark plug is in the contaminated state or even when the onboard battery is of a small capacity, because of short duration of the electric discharge and steep rise-up thereof.

In the capacitor discharge type ignition system mentioned above, there is employed as a booster circuit for charging the capacitor a DC-DC converter which is comprised of a booster transformer and a power transistor for turning on and off repeatedly the booster transformer FIG. 4 is a circuit diagram showing a configuration of a hitherto known CDI type ignition system for an internal combustion engine of a two-wheeled automobile.

Referring to the figure, the ignition system includes a generator or dynamo 1 which is adapted to be driven by a kick starter upon starting of the engine and by the engine (not shown) after the starting thereof, a rectifier circuit 2 connected to the dynamo 1 for rectifying an AC power generated by the dynamo 1 to a DC power, a battery 3 connected to the output of the rectifier circuit 2 for supplying an electric power to the whole system, a DC—DC converter 4 connected to the output of the rectifier circuit 2 and the battery 3 for boosting up the DC voltage, an ignition capacitor 5 having one terminal connected to the output of the DC—DC converter 4 and charged with a boosted voltage supplied therefrom, an ignition coil 7 connected to the other terminal of the ignition capacitor 5 for discharging through the ignition coil 7 the electric charge stored in the capacitor 5 to thereby cause a spark plug to produce a spark, a thyristor 8 connected in series to the ignition coil 7 between the one electrode of the ignition capacitor 5 and the ground for turning on and off a discharge path extending to the ground through the ignition capacitor 5 and the ignition coil 7, and an ignition timing control circuit 10 connected directly to the gate electrode of the thyristor 8 and connected to the output of the rectifier circuit 2 and the buttery 3 via a power supply stabilizer circuit 9 for generating a trigger signal which is applied to the gate of the thyristor 8 for causing it to turn off or open the aforementioned discharge path for thereby causing the electric discharge to take place in the spark plug 6.

In the CDI type engine ignition system mentioned above, there is provided between the input and the output of the DC—DC converter 4 an oscillation stop transistor 11 for stopping oscillation of the DC—DC convert 4. Further, an electromagnetic pickup 12 is connected to the ignition timing control circuit 10, which pickup 12 is disposed in opposition to a rotating shaft of the engine (not shown) for generating an ignition control signal at every predetermined crank angle. Further, a fly-wheel diode 13 is connected in parallel to the ignition coil 7 for limiting a reverse current flow therethrough. Parenthetically, the ignition timing control circuit 10 may be implemented on the basis of a microcomputer, as is known in the art.

The DC—DC converter 4 is comprised of a transformer 41, an oscillation transistor 42 constituted by a power transistor, a resistor 43, a diode 44 and a feedback circuit 45 for sustaining the oscillation, interconnection of which will be apparent from FIG. 4.

The transformer 41 includes a primary winding **41*a* having one end connected to the battery 3 (and hence the output of the rectifier circuit 2) and the other end connected to a collector of the oscillation transistor 42, a charging secondary winding 41*b* wound with polarity opposite to that of the primary winding 41*a* and having one end from which a boosted voltage is outputted through the diode 44, and a switching secondary winding 41*c* wound with the same polarity as the primary winding 41*a* for turning on/off the oscillation transistor 42 at a high frequency on the order of 20 kHz through the feedback circuit 45. On the other hand, the oscillation transistor 42 has a base connected to the battery 3 via a resistor 43 and the output terminal of the switching secondary coil 41*c* via the feedback circuit 45 which is constituted by a resistor 45*a* and a capacitor 45*b*** connected in series to each other.

The ignition coil 7 includes a primary winding **7*a* having one end connected to the ignition capacitor 5 and the other end connected to the ground potential and a secondary coil 7*b* having an output end connected to the spark plug 6**.

The power supply stabilizer circuit 9 includes a transistor 93 which has a collector connected to the output of the battery 3, an emitter connected to the ignition timing control circuit 10 and a base which is connected to the battery 3 via a resistor 91 and to the ground via a constant-voltage diode 92 such as a Zener diode. Connected between the output terminal of the DC—DC converter 4 and the ground is a serial connection of resistors 14 and 15. The oscillation stop transistor 11 has a base connected to a junction between the resistors 14 and 15 and a collector connected to the base of the oscillation transistor 42, and an emitter connected to the ground. Further, the base of the transistor 11 is also connected to the output of the ignition timing control circuit 10 via a resistor 16.

The engine ignition system of the structure described can operate even when the battery voltage becomes low or unavailable due to power consumption.

Now, description will turn to operation of the CDI type ignition system described above.

Upon starting of the engine (not shown), the kick starter (also not shown) is actuated to revolve the dynamo 1, whereby an AC power is generated. The AC power thus generated is rectified by the rectifier circuit 2, whereby a DC voltage is generated and inputted to the DC—DC converter 4. The voltage inputted to the DC—DC converter 4 is applied to the primary winding 41*a* and the base of the oscillation transistor 42 via the resistor 43, which results in turn-on (conduction) of the oscillation transistor 42, allowing a current to flow through the primary winding 41*a* to the ground. Thus, voltages increasing gently are induced in the charging secondary winding 41*b* and the switching secondary winding 41*c*, respectively.

The voltage induced in the switching secondary winding 41*c* is fed to the base of the oscillation transistor 42 via the feedback circuit 45, which results in that the current flowing through the primary winding 41*a* is further increased. When the current flowing through the primary winding 41*a* has attained a saturation level, the boost-up operation stops with the base current of the oscillation transistor 42 decreasing due to the presence of the feedback circuit 45. As a consequence, the oscillation transistor 42 operates to decrease the current flowing through the primary winding 41*a*. In response to the decrease in the current flowing through the primary winding, the voltage induced in the switching secondary winding 41 assumes the reversed polarity, whereupon the oscillation transistor 42 is turned off immediately. As a consequence, the current flowing through the primary winding 41*a* decreases rapidly to zero, bringing about change of the magnetic flux in the opposite direction, which in turn causes a high voltage of reversed polarity to be induced in the charging secondary winding 41*b*. With this voltage, the ignition capacitor 5 is electrically charged via the diode 44. Subsequently, the secondary current decreases to zero, whereupon the base voltage of the oscillation transistor 42 is restored by the output from the rectifier circuit 2.

As the operation described above is repeated, the ignition capacitor 5 is charged progressively, being accompanied with increase in the terminal voltage thereof. When a voltage derived by dividing the capacitor terminal voltage by the division circuit composed of the resistors 14 and 15 exceeds a predetermined level, the oscillation stop transistor 11 is turned on, whereby the base of the oscillation transistor 42 is short-circuited. Thus, the voltage boost-up operation of the DC—DC converter 4 is stopped.

When the oscillation of the DC—DC converter 4 is stopped with the ignition capacitor 5 being sufficiently charged, the ignition timing control circuit 10 outputs a trigger signal to the thyristor 8 in response to an output signal of the electromagnetic pick-up device 12 to thereby turn on the thyristor 8, as a result of which the short-circuit formed by the primary winding 7*a* of the ignition coil 7, the ignition capacitor 5 and the thyristor 8 is closed to allow a current to be discharged from the ignition capacitor 5. Owing to this discharge current, a high voltage is induced in the ignition secondary winding 7*b*, which results in generation of a spark in the spark plug 6. Parenthetically, oscillation of the DC—DC converter 4 can also be stopped by transmission of the trigger signal for the thyristor 8 to the base of the oscillation stop transistor 11 via the resistor 16.

In the conventional ignition system for the engine described above, the electric power supplied to the ignition timing control circuit 10 upon starting of the engine is delivered from the power supply stabilizer circuit 9. In this regard, it is however noted that the operation voltage of the ignition timing control circuit 10 is usually high. By way of example, in the case of the ignition timing control circuit implemented as based on a microcomputer, an operation voltage of about 5 volts is required. On the other hand, the voltage generated by the kick starter via the rectifier circuit 2 lies within a range of 2 to 3 volts, which is obviously too low to operate the ignition timing control circuit 10 without fail. As a result of this, there may arise such situation in which the engine can not be started even when the ignition capacitor 5 is charged to a sufficiently high level, because the thyristor 8 is not turned on by the output of a ignition timing control circuit 10.

As an approach to solve the problem mentioned above, there is disclosed, for example, in Japanese Unexamined Patent Application Publication No. 124262/1991 (JP-A-H3-124262) such an ignition system for an internal combustion engine in which the electric power for the ignition timing control circuit is derived from the charging secondary winding 41*b*. Further, Japanese Utility Model Publication No. 21012/1992 discloses, an ignition system in which a winding for supplying electric power to the ignition timing control circuit 10 is provided at the secondary side of the transformer 41.

However, the ignition system disclosed in the first mentioned publication suffers a difficulty that the charge voltage of the ignition capacitor 5 becomes low, giving rise to a problem that spark generation by the spark plug 6 can not be ensured because the electric power for the ignition timing control circuit 10 is tapped from the charging secondary winding 41*b* of the transformer 41.

On the other hand, in the engine ignition system disclosed in the Utility Model Publication mentioned above, where the power supply winding for the ignition timing control circuit is provided at the secondary side of the transformer 41, there arises a problem that not only an expensive transformer of a large size is required but also a circuit configuration of the ignition system becomes complicated, incurring a high manufacturing cost.

SUMMARY OF THE INVENTION

In the light of the state of the art described above, it is an object of the present invention to provide an improved ignition system for an internal combustion engine which can ensure the start of the engine by a kick starter without fail even when the battery voltage is not sufficiently high and which can be realized inexpensively in a simple structure of a small size.

In view of the above and other objects which will become apparent as description proceeds, there is provided according to a general aspect of the invention an ignition system for an internal combustion engine, which comprises a generator circuit including a rectifier circuit and a battery charged with output of the rectifier circuit, a DC—DC converter connected to an output side of generator circuit and including a booster transformer having a primary winding and a secondary winding for boosting a DC voltage applied to the primary winding to a secondary high DC voltage, an ignition capacitor connected to the secondary winding of the booster transformer to be charged with a boosted voltage outputted from the secondary winding of the transformer of the DC—DC converter, an ignition coil connected to the ignition capacitor for discharging electric charge stored in the ignition capacitor to thereby generate a spark in a spark plug, a thyristor connected in series to the ignition coil with the ignition capacitor being interposed therebetween for opening and closing a discharge path of the ignition capacitor, an ignition timing control circuit connected to a control electrode of the thyristor and the output side of the generator circuit for supplying a trigger signal to the thyristor to close the discharge path by turning on the thyristor, and a secondary voltage feedback means connected to the secondary winding of the transformer of the DC—DC converter for rectifying a secondary voltage component having a polarity opposite to that with which the ignition capacitor is charged, wherein the DC voltage resulting from the rectification is fed back to the output side of the generator circuit.

According to a preferred embodiment of the present invention, the ignition system further comprises a switch means connected between the secondary voltage feedback means and the ignition timing control circuit for applying a feedback voltage from the secondary voltage feedback means to the ignition timing control circuit only when the output voltage of the generator circuit is low.

According to yet another preferred embodiment of the invention, the ignition system may further comprise a voltage boost operation stop means connected between the input side of the DC—DC converter and the output side thereof for stopping operation of the DC—DC converter when the voltage at the ignition capacitor exceeds a predetermined value, and a discharging means connected to the ignition capacitor for decreasing the voltage at the ignition capacitor by gradually discharging the electric charge stored therein for thereby canceling the stop operation of the voltage boost operation stop means at least twice during a single ignition period.

In the ignition system in which the secondary voltage feedback means is connected to the secondary winding of the transformer of the DC—DC converter for generating a secondary DC voltage component having a polarity opposite to the polarity with which the ignition capacitor is charged and feeding back the DC voltage component to the output side of the generator circuit, as described previously decrease in the output voltage of the generator or the battery serving as the power supply source for the ignition timing control circuit can be compensated for by the secondary voltage feedback means mentioned above.

Further, by providing the switch means which is connected between the secondary voltage feedback means and the output electrode of the generator for applying a feedback voltage from the secondary voltage feedback means to the power supply circuit for the ignition timing control circuit only when the output voltage of the generator is low, it is possible to protect the ignition timing control circuit against application of an excessive voltage higher than that intrinsically required for the ignition timing control circuit.

Besides, owing to the voltage boost operation stop means connected between the input side of the DC—DC converter and the output side thereof for stopping operation of the DC—DC converter when voltage at the ignition capacitor exceeds a predetermined value, the ignition capacitor can be protected against application of excessively high voltage.

Additionally, by providing the discharging means which is connected to the ignition capacitor for decreasing the voltage of the ignition capacitor by gradually discharging the electric charge stored therein for thereby releasing the stop operation of the voltage boost operation stop means at least twice during one ignition period, it is possible to sustain intermittently the operation of the DC—DC converter to thereby allow the source voltage to be continuously supplied to the ignition timing control circuit from the secondary winding of the transformer constituting a major part of the DC—DC converter whereby the engine can be started without fail independent of interval length of the ignition.

In addition to the advantageous effects described above, the ignition system according to the invention can be implemented inexpensively in a simplified structure of a small size which ensures the engine start by means of the kick starter without fail even when the generator output voltage or battery voltage is low, to further advantage. Moreover, owing to the operation of the switch means provided between the secondary voltage feedback means and the generator, not only the wasteful power consumption can be suppressed but the measures for protecting the circuit elements from injuries due to high voltage can be spared, which contributes to reduction in the manufacturing cost.

The above and other objects, features and attendant advantages of the present invention will more easily be understood by reading the following description of the preferred embodiments thereof taken, only by way of example, in conjunction with the drawings.

DESCRIPTION OF THE PREFERRED EMBODIMENTS

Now, the present invention will be described in detail in conjunction with preferred or exemplary embodiments thereof by reference to the drawings.

Embodiment 1

Figure 1:
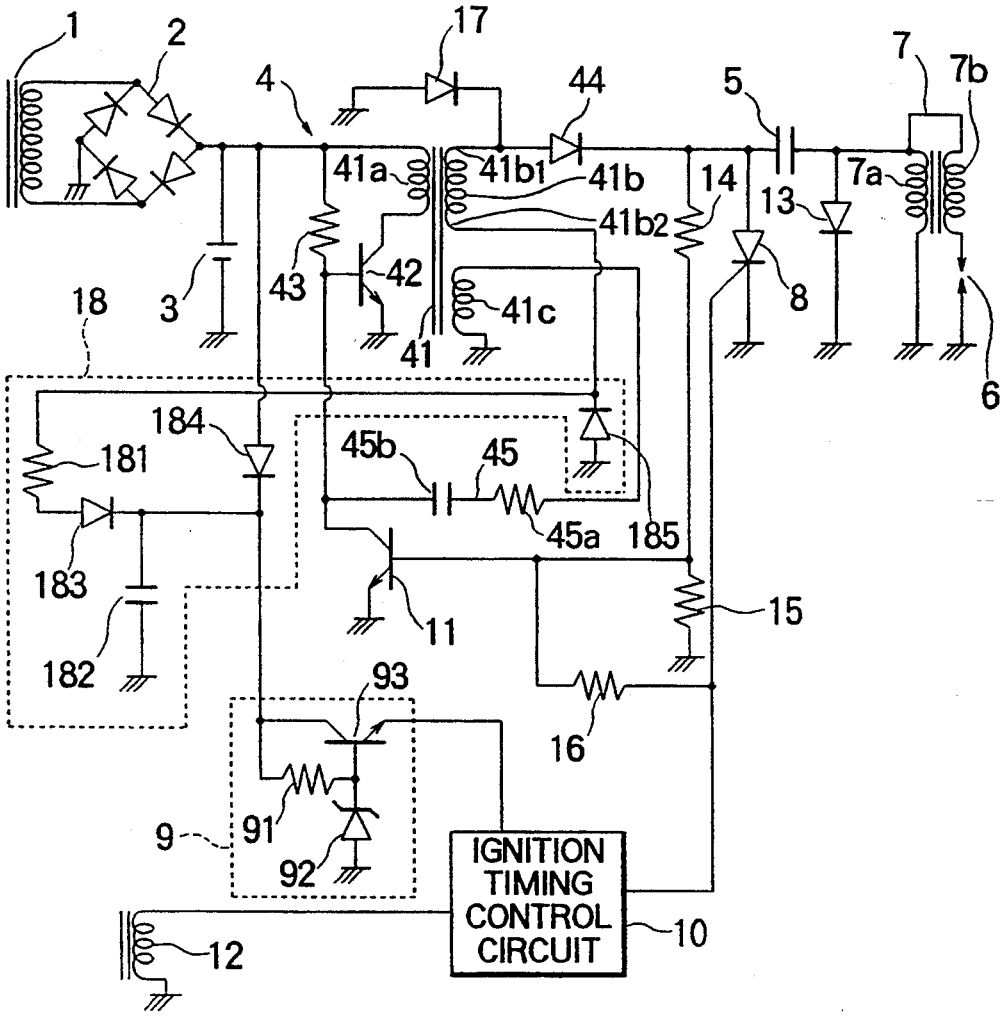
FIG. 1 is a circuit diagram showing a structure of an ignition system for an internal combustion engine according to an embodiment of the present invention.

FIG. 1 shows a circuit configuration of the ignition system according to a first embodiment of the invention. In the figure, reference numerals 1 to 16, 41 to and 91 to 93 denote parts same as or equivalent to those designated by like reference numerals in FIG. 4. Accordingly, repeated description of these parts will be unnecessary. The ignition system for an internal combustion engine according to the instant embodiment differs from that shown in FIG. 4 in that the secondary voltage feedback means is provided for rectifying a secondary voltage component having a polarity opposite to that with which the ignition capacitor 5 is charged and feeding back the rectified voltage to the output of the battery 3 and hence to the stabilized power supply circuit 9, for the ignition timing control circuit 10.

The secondary voltage feedback means mentioned above is constituted by a diode 17 connected between an output terminal **41*b*1 of the charging secondary winding 41*b* of the transformer 41 to which the ignition capacitor 5 is connected and the ground in the forward direction relative to the winding 41*b*, and an integrating circuit 18 connected to the other output terminal 41*b*2** of the charging secondary winding 41*b* of the transformer 41. The integrating circuit 18 includes a resistor 181 connected to the output terminal 41*b*2 of the charging secondary winding 41*b* of the transformer 41 and a capacitor 182 connected to the other end of the resistor 181 and the ground, wherein a diode 183 is connected between the resistor 181 and the capacitor 182 in the forward direction relative to the capacitor 182, while a diode 185 is connected between the output terminal 41*b*2 of the charging secondary winding 41*b* and the ground in the forward direction relative to the charging secondary winding 41*b*. Further, connected between the battery 3 and the power supply stabilizer circuit 9 for the ignition timing control circuit 10 a diode 184 which serves to prevent the current from flowing backwardly to the battery 3.

Next, description will turn to operation of the ignition system according to the instant embodiment. At this juncture, it should be mentioned that the charging operation for the ignition capacitor 5 is same as in the case of the ignition system described hereinbefore by reference to FIG. 4. Accordingly, repeated description is omitted. The voltage generated by the kick starter or the like is rectified by the rectifier circuit 2, whereby the oscillation transistor 42 is turned on while the rectified voltage is gently boosted up through the transformer 41 of the DC—DC converter 4. As a result of this, a current flows through the diode 17, the charging secondary winding 41*b*, the resistor 181 and the diode 183, whereby the capacitor 182 is charged. This capacitor 182 serves as a power source for the power supply stabilizer circuit 9. The current mentioned above is prevented from flowing backwardly to the battery 3 by the diode 184.

As is appreciated from the above description, the voltage generated by the DC—DC converter and having opposite polarity to that of the voltage applied to ignition capacitor 5 is made use of as a source voltage for the stabilized power supply circuit 9 for the ignition timing control circuit 10 according to the teaching of the invention incarnated in the instant embodiment, whereby the source voltage for the ignition timing control circuit 10 can sufficiently be ensured even when the engine is started by actuating the kick starter from the state in which the battery 3 is consumed. Thus, the engine can be started with high reliability, essentially regardless of the state of the battery 3.

Embodiment 2

A second embodiment of the invention will be described by reference to FIG. 2, in which the reference numerals 1 to 16, 41 to 45 and 91 to 93 denote circuit components same as or equivalent to those described hereinbefore. Accordingly, repeated description thereof will be unnecessary. The ignition system according to the instant embodiment differs from the first embodiment in that the secondary voltage feedback means for rectifying a secondary voltage component of the transformer of the DC—DC converter having the polarity opposite to that of the voltage with which the ignition capacitor 5 is charged to thereby feedback the rectified voltage to the input side of the stabilized power supply circuit 9 for assuring constantly the power supply for the ignition timing control circuit 10 includes additionally a switch circuit 19 for enabling the voltage feedback only when the battery output voltage is lower than a predetermined level.

Figure 2:
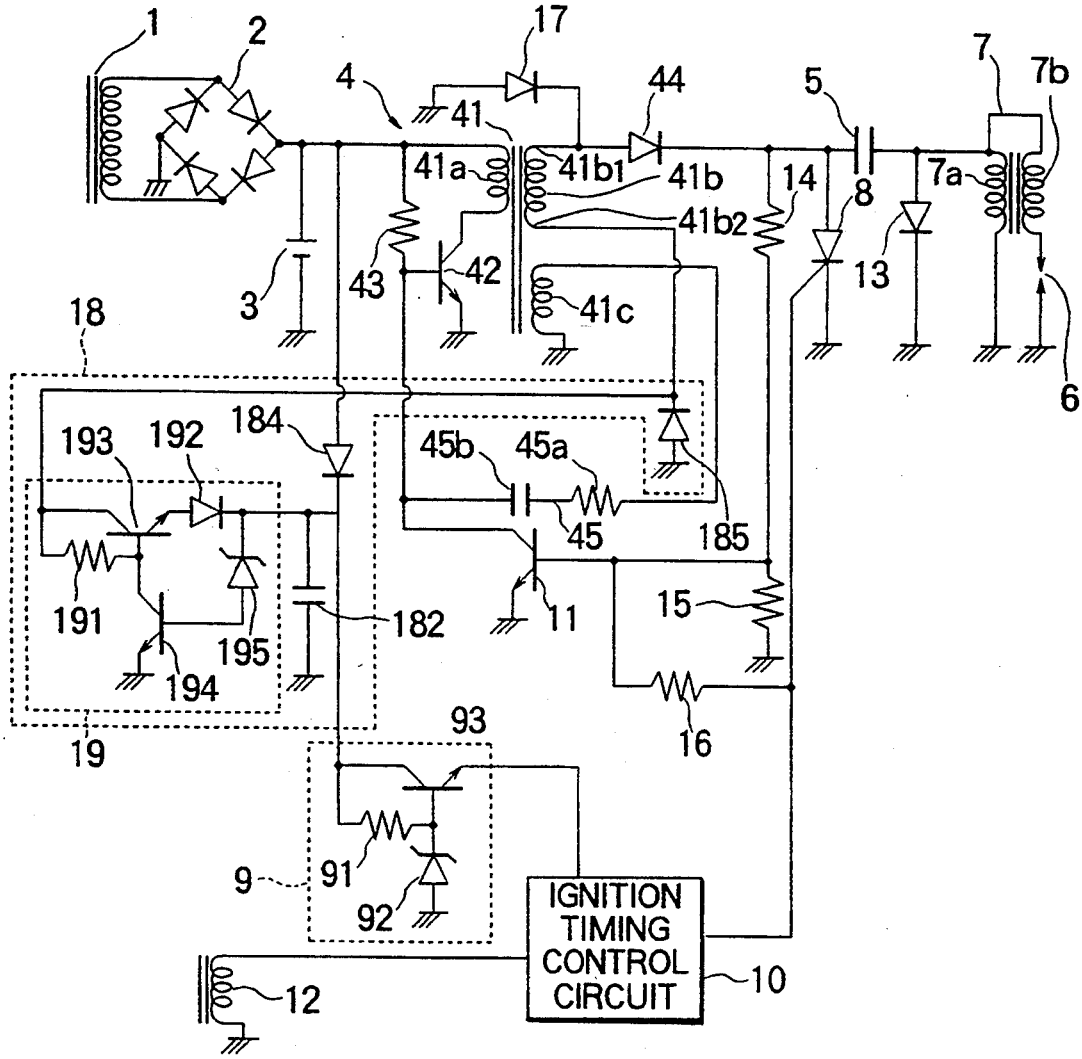
FIG. 2 is a circuit diagram showing an ignition system according to a second embodiment of the invention.

As can be seen in FIG. 2, the switch circuit 19 includes a transistor 193 having a collector connected to the base via a resistor 191 and to the terminal 41*b*2 of the secondary winding 41*b* of the transformer 41 and an emitter connected to the voltage stabilizer circuit 9 via a diode 192, and a transistor 194 having a collector connected to the base of the transistor 193, an emitter connected to the ground and a base connected to the power supply stabilizer circuit 9 via a constant-voltage diode 195 which may be constituted by a Zener diode.

In operation, the voltage generated by the generator 1 in response to operation of the kick starter is rectified by the rectifier circuit 2 and gradually boosted up by the transformer 41 with the oscillation transistor 42 being turned on. The boosted voltage induced in the charging secondary winding 41*b* is supplied to the switch circuit 19. On the other hand, the output voltage of the battery 3 is applied to the output terminals of the diode 192 and the constant-voltage diode 195 via the diode 184. When the battery voltage applied to the diode 192 or the constant-voltage diode 195 increases beyond a predetermined voltage level determined by the constant-voltage diode 195, the transistor 194 is turned on to interrupt the base current of the transistor 193 which is thus turned off, as a result of which the current supplied from the charging secondary winding of the DC—DC converter 4 to the source capacitor 182 is interrupted, whereby the voltage feedback to the power supply stabilizer circuit 9 is inhibited.

As is apparent from the above description, with the voltage feedback means according to the instant embodiment, the voltage boosted up by the DC—DC converter 4 is fed to the battery 3 stabilized voltage power supply circuit 9 for the ignition timing control circuit 10 only when the output voltage of the battery is lower than a predetermined level regulated by the constant-voltage diode 195. By virtue of this feature, the wasteful power consumption is prevented. Besides, measures for protecting the circuit components from injuries due to excessively high voltage can be spared, which in turn means that the ignition system can be implemented without increasing the manufacturing cost any appreciably as compared with the conventional ignition system. In other words, when the battery voltage becomes high, the boosted voltage outputted from the DC—DC converter 4 increases correspondingly. Consequently, the voltage as fed back becomes excessively higher than the voltage demanded by the ignition timing control circuit 10, resulting in increase in the power consumption in the individual circuits components, which may thereby be injured. However, such excessive voltage feedback can be prevented owing to the voltage feedback means which incorporates the switch circuit 19 as described above. Further, any further measures for protecting the circuit components from the excessively high voltage is not required.

Embodiment 3

Figure 3:
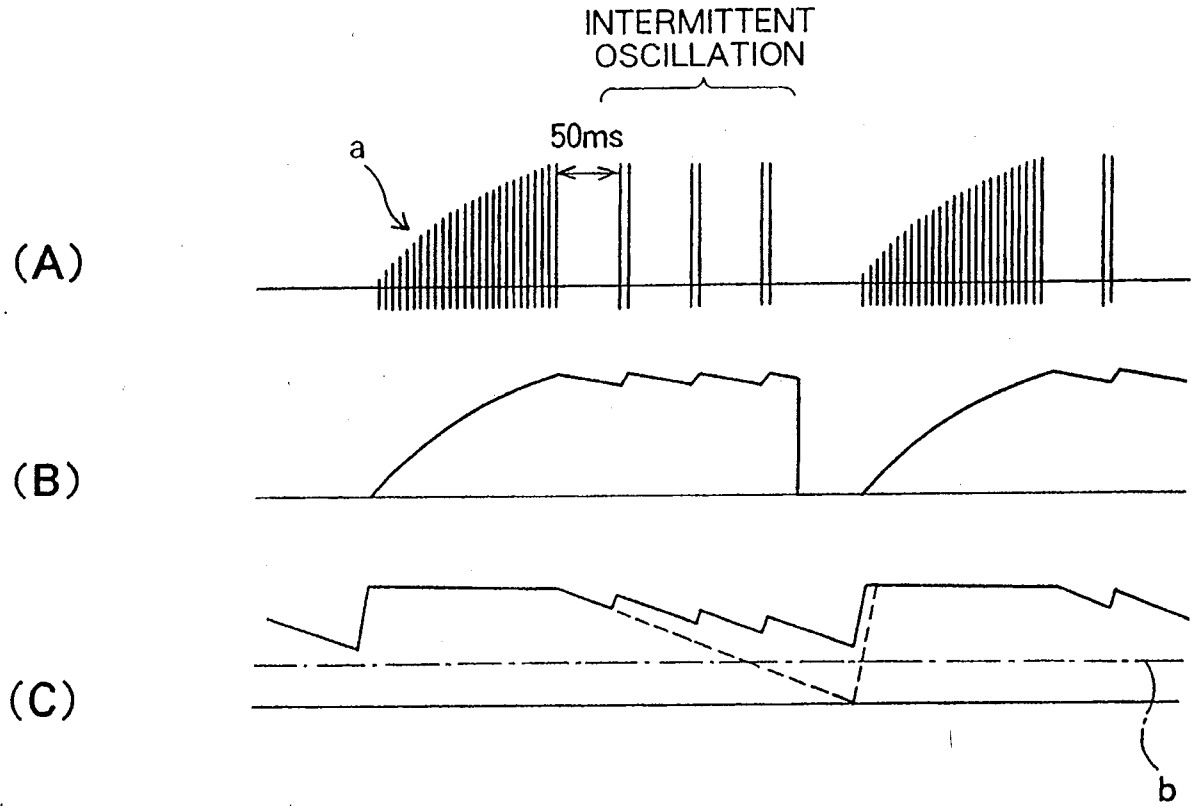
FIGS. 3(A–C) are a waveform diagram for illustrating operation of an ignition system according to a third embodiment of the invention.

Description will now be made of a third embodiment of the invention by reference to FIG. 3 which is a timing diagram for illustrating operation of the ignition system according to the third embodiment. The ignition system according to the instant embodiment differs from the first and second embodiments in that a discharge means is provided for causing the ignition capacitor 5 to gradually discharge to a voltage level for canceling the stop operation of the oscillation stop transistor 11 at least twice within a single ignition cycle.

The discharge means mentioned above can be realized by selecting the values of the resistors 14 and 15 shown in FIGS. 1 and 2 so that the conditions mentioned hereinafter can be satisfied for the capacity of the ignition capacitor 5. Description will now be made of the operation of this discharge means by reference to FIG. 3, in which the output voltage of the DC—DC converter 4 is illustrated at (A). As can be seen, upon starting of the engine, the output voltage of the DC—DC converter 4 is initially boosted up relatively steeply, as indicated at a, by the transformer 41 every times the oscillation transistor 42 is turned off. When the ignition capacitor 5 is charged sufficiently, the oscillation stop transistor 11 is turned on to stop the voltage boost-up operation of the DC—DC converter 4. Accordingly, if the discharge means mentioned above is not provided, after the voltage boost-up operation of the DC—DC converter 4 the engine is ignited, and the voltage boost-up operation of the DC—DC converter 4 is stopped until the ignition capacitor 5 is discharged. During this period, the voltage feedback to the input circuit for the ignition timing control circuit 10 is stopped, and hence the source voltage of the capacitor 182 decreases gradually, as shown by a broken line curve in FIG. 4 at (C), to a level lower than a minimum level b of the source voltage at which the ignition timing control circuit 10 can operate, unfavorably to the smooth start of the engine.

Figure 4:
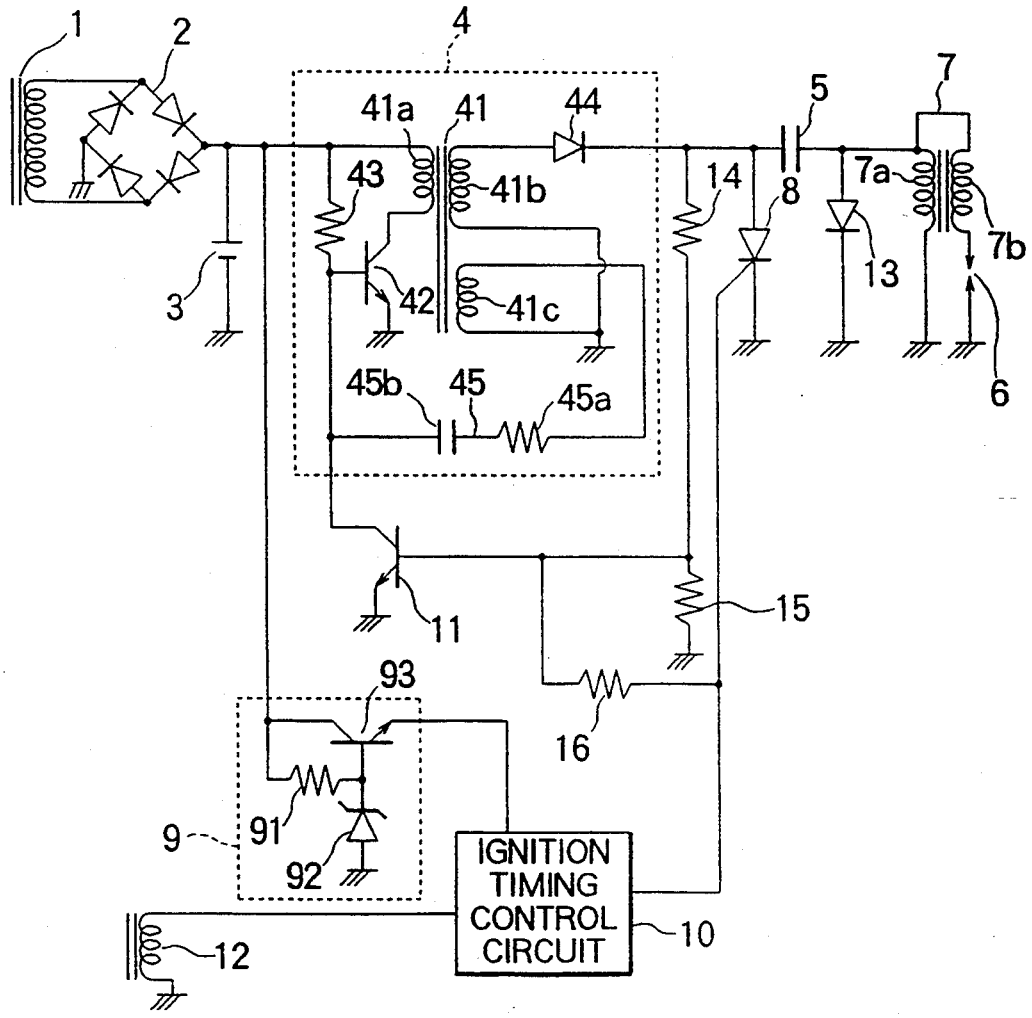
FIG. 4 PRIOR ART
FIG. 4 is a circuit diagram showing a structure of an ignition system known heretofore.

Such being the circumstances, it is taught according to the invention incarnated in the instant embodiment to lower the voltage of the ignition capacitor 5 by discharging electric charge stored therein through the discharge means mentioned above to thereby cause the DC—DC converter 4 to operate intermittently at least twice during a single ignition period, for example, at every 50 msec., as indicated at (A), to thereby prevent the voltage of the discharge capacitor from being lowered, as shown at (B) in FIG. 4, and hence prevent the voltage of the source capacitor 182 from being lowered, as shown at (C), as a result of which the source voltage can continuously be sustained for the ignition timing control circuit 10. Parenthetically, selection of the values of the resistors 14 and 15 so that the operation described above can be effectuated falls within the skill of the person having ordinary knowledge in the art. Of course, other resistors than the resistors 14 and 15 may be additionally provided between the ignition capacitor 5 and the ground as the circuit components constituting the discharge means.

Many features and advantages of the present invention are apparent form the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described. Accordingly, all suitable modifications and equivalents may be resorted to, falling within the spirit and scope of the invention.

We claim:

1. An ignition system for an internal combustion engine, comprising:

a generator circuit including a generator, a rectifier circuit and a battery charged with output of said rectifier circuit;

a DC—DC converter connected to an output side of said generator circuit and including a transformer having a primary winding and a secondary winding for boosting a rectified voltage applied to said primary winding from said generator circuit;

an ignition capacitor connected to said secondary winding of said transformer of said DC—DC converter to be charged with a boosted voltage outputted from said secondary winding;

an ignition coil connected to said ignition capacitor for discharging electric charge stored in said ignition capacitor to thereby generate a spark in a spark plug of said engine;

a thyristor connected in series to said ignition coil with said ignition capacitor being interposed therebetween for opening and closing a discharge path of said ignition capacitor;

an ignition timing control circuit connected to the output side of said generator circuit and having an output connected to a control electrode of said thyristor for supplying a trigger signal to said control electrode to thereby close said discharge path by turning on said thyristor; and secondary voltage feedback means connected to the secondary winding of said transformer of said DC—DC converter for rectifying a secondary voltage component having a polarity opposite to the polarity with which said ignition capacitor is charged, wherein the DC voltage resulting from the rectification is fed to the output side of said generator circuit.

2. An ignition system according to claim 1, wherein said transformer has the charging secondary winding having one end connected to said ignition capacitor, said secondary voltage feedback means including:

a first rectifier element connected to said one end of said transformer in forward direction relative thereto;

a second rectifier element having an input terminal connected to the other end of said charging secondary winding and an output terminal connected to the output side of said generator circuit in forward direction relative to said charging secondary winding; and a capacitor having one terminal connected to the output terminal of said second rectifier element and the other terminal connected to the ground, wherein an AC power supplied from said other end of said charging secondary winding of said transformer is rectified by said second rectifier elements and supplied to the output side of said generator circuit.

3. An ignition system according to claim 2, wherein said ignition timing control circuit is connected to the output side of said generator circuit via a diode for preventing the output of said secondary voltage feedback means from being applied to said generator circuit.

4. An ignition system according to claim 1, further comprising a power supply stabilizer circuit inserted between the output of said secondary voltage feedback means and said ignition timing control circuit for stabilizing power supply to said ignition timing control circuit.

5. An ignition system according to claim 1, further comprising:

voltage boost operation stop means provided between the input side of said DC—DC converter and the output side thereof for stopping operation of said DC—DC converter when the voltage at said ignition capacitor exceeds a predetermined value; and discharging means connected to said ignition capacitor for decreasing the voltage at said ignition capacitor by gradually discharging the electric charge stored therein for thereby canceling the stop operation of said voltage boost operation stop means at least twice during a single ignition period.

6. An ignition system according to claim 5, wherein said DC—DC converter includes an oscillation transistor having a collector connected to one end of said primary winding which has the other end connected to the output of said generator circuit, a base connected to the output of said generator circuit and a switching secondary winding of said transformer, and an emitter connected to the ground;

said voltage boost operation stop means including an oscillation stop transistor having a collector connected to the base of said oscillation transistor, an emitter connected to the ground and a base connected to said one end of said discharging secondary winding via a voltage divider circuit;

said discharging means includes a resistor constituting a part of said voltage divider circuit and having one end connected to the base of said oscillation stop transistor and having the other end connected to said one end of said charging secondary winding of said transformer.

7. An ignition system for an internal combustion engine, comprising:

a generator circuit including a generator, a rectifier circuit and a battery charged with output of said rectifier circuit;

a DC—DC converter connected to an output side of said generator circuit and including a transformer having a primary winding and a secondary winding for boosting a rectified voltage applied to said primary winding from said generator circuit;

an ignition capacitor connected to said secondary winding of said transformer of said DC—DC converter to be charged with a boosted voltage outputted from said secondary winding;

an ignition coil connected to said ignition capacitor for discharging electric charge stored in said ignition capacitor to thereby generate a spark in a spark plug of said engine;

a thyristor connected in series to said ignition coil with said ignition capacitor being interposed therebetween for opening and closing a discharge path of said ignition capacitor;

an ignition timing control circuit connected to the output side of said generator circuit and having an output connected to a control electrode of said thyristor for supplying a trigger signal to said control electrode to thereby close said discharge path by turning on said thyristor;

secondary voltage feedback means connected to the secondary winding of said transformer of said DC—DC converter for rectifying a secondary voltage component having a polarity opposite to the polarity with which said ignition capacitor is charged, wherein the DC voltage resulting from the rectification is fed to the output side of said generator circuit; and switch means connected between said secondary voltage feedback means and the output electrode of said generator for applying a feedback voltage from said secondary voltage feedback means to the output of said generator only when the output voltage of said generator is low.

8. An ignition system according to claim 7, wherein said transformer has the charging secondary winding having one end connected to said ignition capacitor, said secondary voltage feedback means including a first rectifier element connected to said one end of said transformer in forward direction relative thereto, a second rectifier element having an input terminal connected to the other end of said charging secondary winding via a first switching element and an output terminal connected to the output side of said generator circuit in forward direction relative to said charging secondary winding, and a capacitor having one terminal connected to the output terminal of said second rectifier element and the other terminal connected to the ground, wherein an AC power supplied from said other end of said charging secondary winding of said transformer is rectified by said second rectifier element and supplied to the output side of said generator circuit;

wherein said switch means includes a constant voltage diode connected to the output side of said generator circuit and a gate electrode of said first switching element via a second switching element to thereby turn off said first switching element when an output voltage of said generator circuit exceeds a voltage determined by a said constant-voltage diode.

9. An ignition system according to claim 7, further comprising:

voltage boost operation stop means provided between the input side of said DC—DC converter and the output side thereof for stopping operation of said DC—DC converter when the voltage at said ignition capacitor exceeds a predetermined value; and discharging means connected to said ignition capacitor for decreasing the voltage at said ignition capacitor by gradually discharging the electric charge stored therein for thereby canceling the stop operation of said voltage boost operation stop means at least twice during a single ignition period.

10. An ignition system according to claim 9, wherein said DC—DC converter includes an oscillation transistor having a collector connected to one end of said primary winding which has the other end connected to the output of said generator circuit, a base connected to the output of said generator circuit and a switching secondary winding of said transformer, and an emitter connected to the ground;

said voltage boost operation stop means including an oscillation stop transistor having a collector connected to the base of said oscillation transistor, an emitter connected to the ground and a base connected to said one end of said discharging secondary winding via a voltage divider circuit;

said discharging means includes a resistor constituting a part of said voltage divider circuit and having one end connected to the base of said oscillation stop transistor and having the other end connected to said one end of said charging secondary winding of said transformer.

11. An ignition system according to claim 7, wherein said ignition timing control circuit is connected to the output side of said generator circuit via a diode for preventing the output of said secondary voltage feedback means from being applied to said generator circuit.

12. An ignition system according to claim 7, further comprising a power supply stabilizer circuit inserted between the output of said secondary voltage feedback means and said ignition timing control circuit for stabilizing power supply to said ignition timing control circuit.

* * * * *